United States Patent [19]

Martin et al.

[11] Patent Number: 4,510,033

[45] Date of Patent: Apr. 9, 1985

[54] FROZEN ELECTROLYTE BATH REMOVAL APPARATUS

[75] Inventors: Robert J. Martin, Mars; Lawrence W. Cisko, Irwin; Bernard C. Turley, Pittsburgh, all of Pa.

[73] Assignee: Aluminum Company of America, Pittsburgh, Pa.

[21] Appl. No.: 621,938

[22] Filed: Jun. 18, 1984

[51] Int. Cl.[3] ..... C25C 3/10; C25C 3/14

[52] U.S. Cl. ..... 204/245; 204/279; 204/297 R

[58] Field of Search ..... 204/67, 243 R–247, 204/225, 297 R, 279; 15/4

[56] References Cited

U.S. PATENT DOCUMENTS

| | | | |
|---|---|---|---|
| 3,663,411 | 5/1972 | Springer | 204/243 |
| 3,769,195 | 10/1973 | Weterings | 204/244 |
| 4,119,505 | 10/1978 | Baillot et al. | 204/245 X |
| 4,217,197 | 8/1980 | Harder et al. | 204/243 R |
| 4,442,593 | 4/1984 | Holmberg | 204/297 R X |

*Primary Examiner*—Donald R. Valentine

*Attorney, Agent, or Firm*—Max L. Williamson

[57] ABSTRACT

Apparatus for removing frozen electrolyte bath from surface portions of an electrode body, the apparatus having crust breakers adapted to penetrate and fracture the crust which breaks into discrete pieces and which separates from the body. The crust breakers are attached to a frame through a linkage system which is adapted to move the breakers along a line of travel substantially adjacent to the salt encrusted surfaces of the body. With application of sufficient power to the crust breakers to penetrate and fracture the crust, substantially all of the crust is removed from the electrode body with minimal generation of dust and noise.

10 Claims, 13 Drawing Figures

FROZEN ELECTROLYTE BATH REMOVAL APPARATUS

BACKGROUND OF THE INVENTION

The present invention relates, in general, to apparatus used in the electrolytic production of metals, and more particularly, to apparatus for removing bath residue which accumulates and adheres to an electrode during production of the metal.

In the electrolytic production of a metal such as aluminum, for example, current is passed through a molten salt bath and an aluminum compound dissolved therein is reduced to yield aluminum. Typically, one of the electrodes employed in such a process is a carbon body affixed to a metal electrical conductor rod or bar which is suspended in the molten salt bath and functions as the anode. During production of the metal, solid particles of salt are placed on top of the molten salt and the carbon to prevent heat loss and prevent air burning of the carbon. The solid particles partially melt and form a hard crust of frozen salt along the surface of the molten bath and the crust adjacent the carbon body adheres thereto. Carbon is consumed in the process and the carbon body, therefore, must be replaced from time to time. To accomplish this, the metal conductor bar is detached from the current source and the used carbon body and bar assembly is lifted from the bath, and a new anode assembly is inserted into the bath.

A substantial amount of the carbon body remains on the used assembly and is referred to as the butt. The butt must be removed from the bar in order to reuse the bar, and it is also desirable to salvage the butt for making additional carbon bodies as well as salvage the frozen salt bath adhering to the butt. Before the carbon can be salvaged, the accumulation of salt bath frozen to the butt must be removed to prevent contamination of the carbon. The frozen bath may be removed by the use of manually operated pneumatic chipping hammers, but such a method is inefficient, expensive, and creates a noise and dust problem. It is proposed in Baillot et al U.S. Pat. No. 4,119,505 to mount a pneumatic hammer on apparatus which may be operated from a remote station. The apparatus is adapted to selectively move the pneumatic hammer to positions adjacent an encrusted butt and thereafter actuate the hammer against the frozen bath to break it away from the butt. Although this is an improvement over manually operating a pneumatic hammer, it does not eliminate the noise and dust problem. Other apparatus proposed for removal of the frozen crust is described in British Pat. No. 2,100,754 whereby the crust is removed by milling cutters. Use of this proposed apparatus also generates appreciable dust and noise.

It is desirable, therefore, to provide an efficient, economical method of removing frozen salt bath from an electrode and eliminate the noise and dust problem that has been attendant with methods known heretofore.

SUMMARY OF THE INVENTION

In a device of the present invention, a clamping means is provided to hold and maintain a metal rod having a salt encrusted butt affixed thereto in a centered fixed position within the device. Crust breaking means disposed so as to contact the top, side and ends of the salt encrusted butt are activated by power means to break through the crust, fracture the crust into pieces and dislodge the pieces to fall free of the butt.

It is an objective of this invention to provide an efficient, economical device for removing encrusted bath material from an electrode butt.

It is also an objective of this invention to effect separation of the bath material from the butt without generating noise or dust.

It is a further objective of this invention to effect a substantially complete separation between the bath material and butt in order that the separated bath material and the butt may be recovered for reuse.

These and other objectives and advantages of this invention will be more fully appreciated with reference to the following description of a preferred embodiment of the invention and the appended drawings.

DESCRIPTION OF A PREFERRED EMBODIMENT

Figure 1:
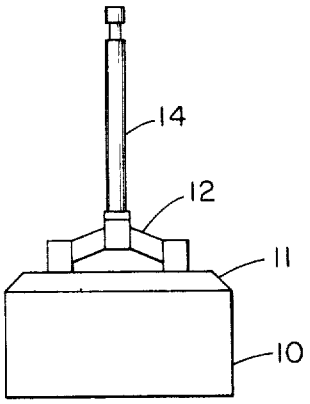
FIG. 1 is a side view of a typical assembly of a carbon anode body and a metal conductor bar prior to use in an electrolytic process for producing aluminum.
Figure 2:
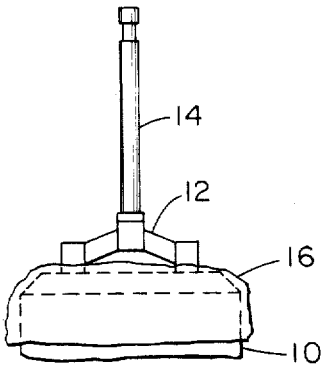
FIG. 2 shows the assembly of FIG. 1 after use in an electrolytic process for producing aluminum.

FIG. 1 is a side view of a typical carbon anode assembly for use in producing aluminum by electrolysis. The carbon anode body 10 has a yoke 12 embedded therein and the yoke is connected to an upwardly extending, electrically conductive rod 14 which is utilized as an electrical conductor between a power source and the anode body and to suspend the anode body in a molten electrolyte having an aluminum salt dissolved therein. During the process of producing aluminum, carbon is consumed and a hard, tenacious crust 16 of frozen electrolyte forms adjacent upper surface portions of the anode body. Such crust must be removed from the butt remainder of the anode body in order to salvage and reuse the carbon. FIG. 2 shows the anode assembly of FIG. 1 as it might typically appear after use in and removal from the electrolyte.

Figure 3:
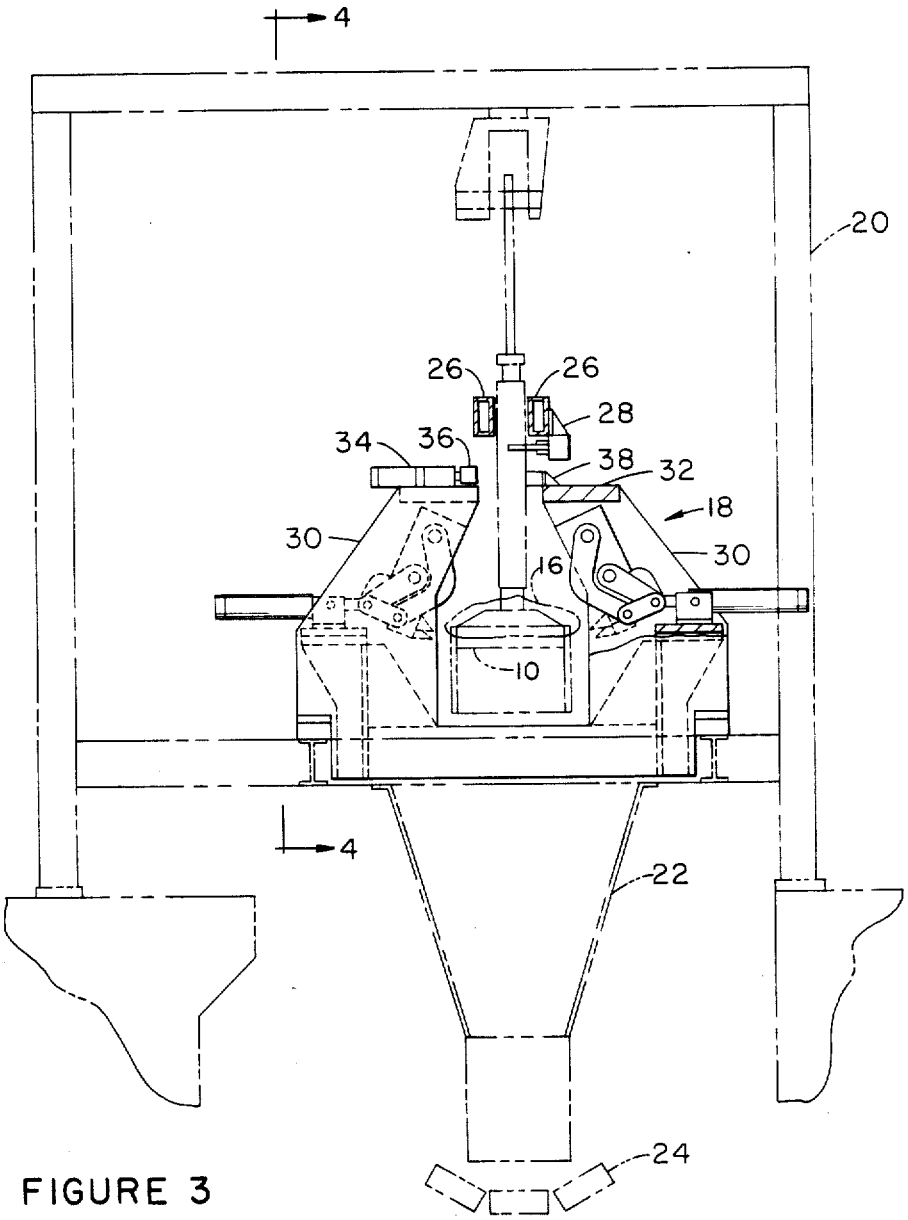
FIG. 3 is an end view of the apparatus of this invention having a left-hand side and a cross-section through the right-hand side of an anode butt disposed therein.
Figure 4:
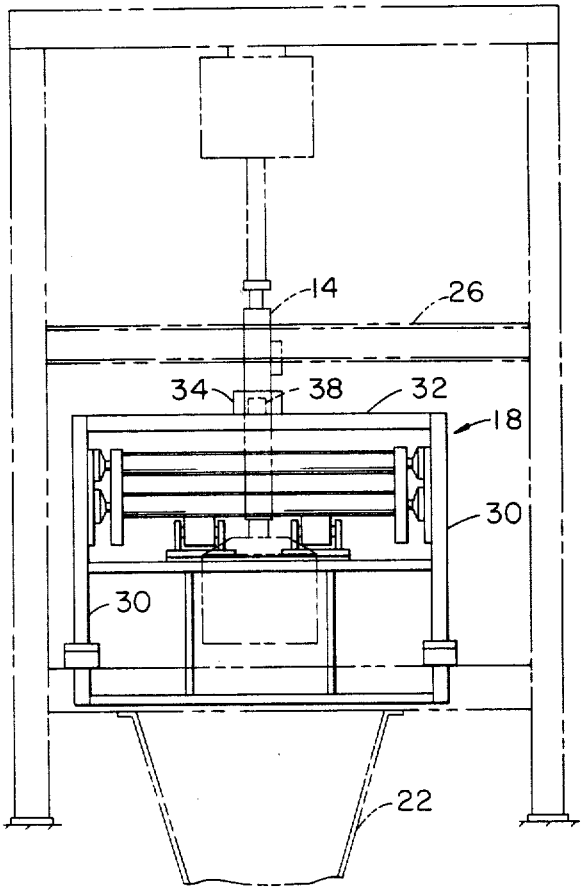
FIG. 4 is a side view of the apparatus of this invention shown in FIG. 3.
Figure 10:
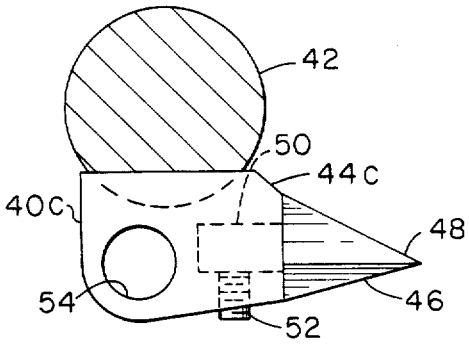
FIGS. 8, 9 and 10 are plan views of crust breakers of apparatus of this invention in assembly with sections of the breaker shaft.
Figure 11:
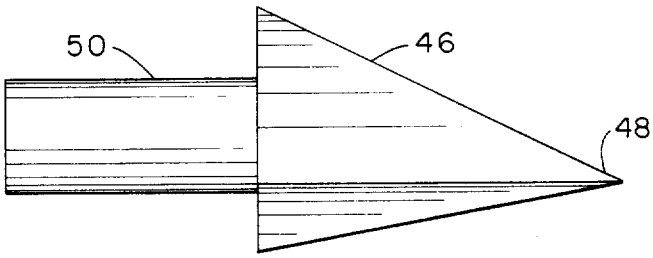
FIG. 11 is a plan view of a typical breaker tip of apparatus of this invention.

To remove the crust from an anode butt by apparatus of this invention, the assembly is moved by an overhead conveyor to the bath removal apparatus of this invention. As shown in FIGS. 3 and 4, the bath removal apparatus 18 is mounted on a structural support frame 20. A hopper 22 extends downwardly from the apparatus 18 and frame 20 to a belt conveyor 24 which transports salt crust fragments separated from the anode butt. Guide rails 26 are provided above the apparatus to guide the anode assembly into the apparatus 18, and a rod stop 28 is attached to one of the guide rails to position the assembly in the center of the apparatus. FIG. 3 shows an end view of the apparatus having an anode assembly centered therein, and FIG. 4 shows a side view of the apparatus and anode assembly.

The apparatus frame includes opposing end plates 30 which are connected to structural frame 20 and top frame plates 32 which are attached to the end plates. A hydraulic selectively movable clamp 34 is mounted to one of the top frame plates 32 on the centerline of the apparatus. The clamp 34 includes a mouth 36 adapted to partially surround the anode assembly rod 14. A clamp back-up 38 is mounted on the centerline of the apparatus on the top frame plate 32 opposite the top frame plate having the clamp 34 mounted thereon. When the anode assembly is stopped in the desired position in the apparatus, the hydraulic clamp 34 is actuated to partially surround the rod 14 and hold the rod against the clamp back-up 38. Thus, the anode assembly is held in a fixed position with reference to the apparatus for removal of the crust.

Details of the bath removal apparatus 18 will now be explained with reference to FIGS. 5 and 6. In the plan drawing of FIG. 5, the apparatus is shown without the top frame plates 32 for purposes of clarity. Generally, the apparatus is comprised of a plurality of crust breakers 40 mounted on rotating shafts 42 extending longitudinally on left- and right-hand sides of the apparatus. Actuation of the apparatus causes the crust breakers 40 to advance along a line of travel which is transverse to the length of the butt and substantially conforms to the surface contour of the butt from a position adjacent the sides of the crust encased anode butt to a position on top of the butt shown in FIG. 5. The crust breakers are advanced with sufficient force to gouge into the crust, whereby the crust is fractured and breaks into fragments. Substantially all of the crust is fractured into discrete pieces which either fall or may be brushed from the butt surface into the hopper 22.

Figure 7:
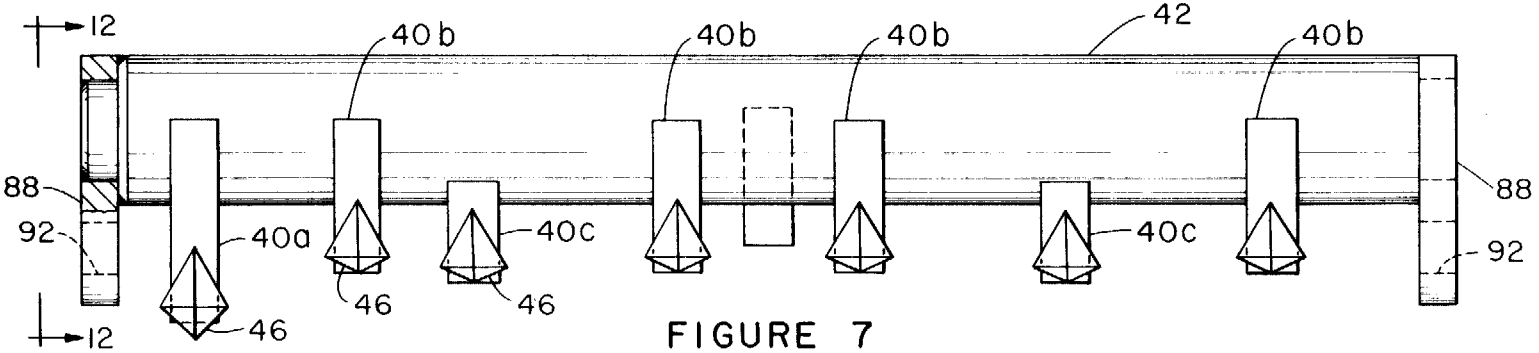
FIG. 7 is a plan view of the left-hand breaker shaft of this invention having the crust breakers and end connector plates affixed thereto.

By reference to FIGS. 7, 8, 9, 10, 11 and 12, the general arrangement of the crust breakers 40 on the left-hand rotating shaft 42 will now be explained. The crust breakers 40 are comprised of shaped plate arms 44 and breaker tips 46. The shape of the arms and disposition on the shaft 42 vary with the shape of the anode body 10 to be cleaned of crust. For this preferred embodiment, the outermost breaker 40*a*, as may be seen in FIG. 7, is disposed on the arm 42 with the breaker tip 46 spaced from the centerline a greater distance than the tips on the remaining breakers in order that the tip may follow a line of travel along beveled surface 11 (FIG. 1) on the ends of the anode. The breaker tips 46 (FIG. 11) have a generally pyramid-shaped breaking end 48 and a shaft 50. The tip is attached to the arm 44 by press fitting the shaft 50 into a suitably sized hole in the end of the arm and maintaining the tip in position with set screws 52 through the arm and bearing against the shaft. Alternative means of attaching the tip 46 to the arm 44 can be employed, but it is preferred that the tips be attached in a manner that they may be replaced as wear occurs. The arms 44 are attached to the shaft 42 by welding and, in this preferred embodiment, are fitted into machined slots in the shaft for ease of assembly and arm support, but the arms could also be cut to fit the circumference of the shaft and welded directly thereto. It may be noted that arm 44*c* varies from arms 44*a* and 44*b* to the extent that a bored hole 54 is provided therein. The bored hole 54 is provided for connection with a hydraulic drive system to actuate the shaft 42, as will be explained later.

Figure 5:
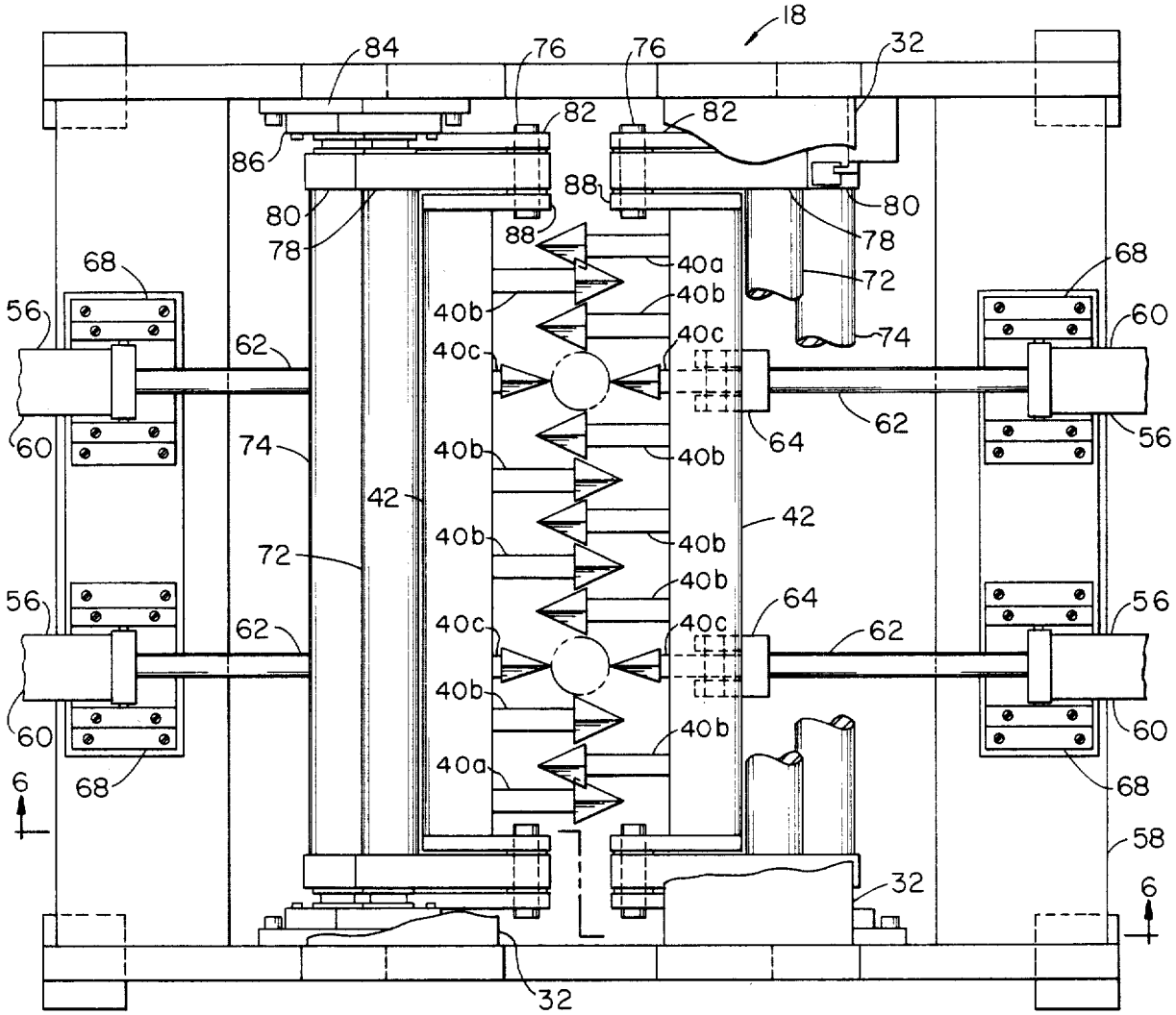
FIG. 5 is a plan view of apparatus of this invention with top frame plates not shown for purposes of clarity. The right-hand side of the apparatus is shown with portions of the apparatus only partially shown for purposes of clarity.
Figure 9:
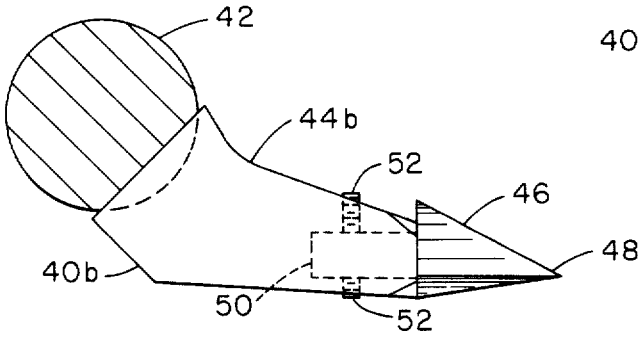
Figure 8:
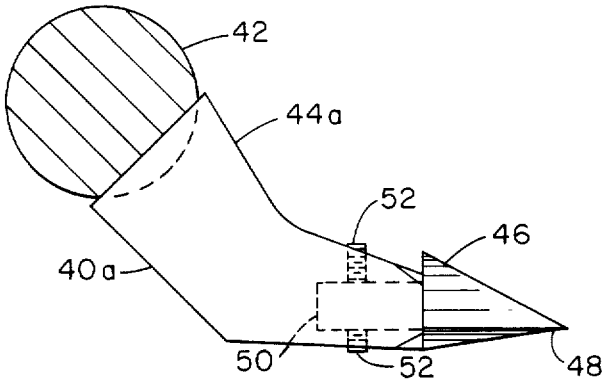

As may be seen in FIG. 5, the left- and right-hand shaft 42 and crust breakers 40 are adapted to mesh the crust breakers in their closed position at the completion of the crust breaking cycle, with the exception of crust breakers 40*c*. Crust breakers 40*c* are disposed on the shaft to abut the anode yoke 12 (shown in dashed lines). The foregoing description of the left-hand breaker shaft 42 and crust breakers 40 is appropriate for the right-hand shaft and breaker assembly as well.

The power to drive the crust breakers through the crust on the anode surface is provided by four hydraulic power units 56. The power units are rotatably attached to bottom frame plates 58 disposed between the opposing end plates 30 on the left- and right-hand sides of the apparatus. Two power units 56 are provided for each side of the apparatus and are positioned on the frame plate 58 for alignment with and connection to breaker arms 44*c* on the breaker shafts 42. The hydraulic power units 56 comprise a hydraulic cylinder 60 having a hydraulically movable piston therein connected to a piston shaft 62. A clevis 64 is attached to the free end of the shaft 62 and is connected with breaker arm 44*c* by a pin 66 extending through the clevis 64 and bored hole 54 of breaker arm 44*c*. The pin 66 is attached to each arm of the clevis 64 and is free to rotate within a bushing in the breaker arm hole 54.

To rotatably attach the hydraulic power unit 56 to the lower frame plate 58, a trunion mount 68 is attached to the plate and the power unit is supported therein with trunions 70 affixed to the power unit.

Figure 12:
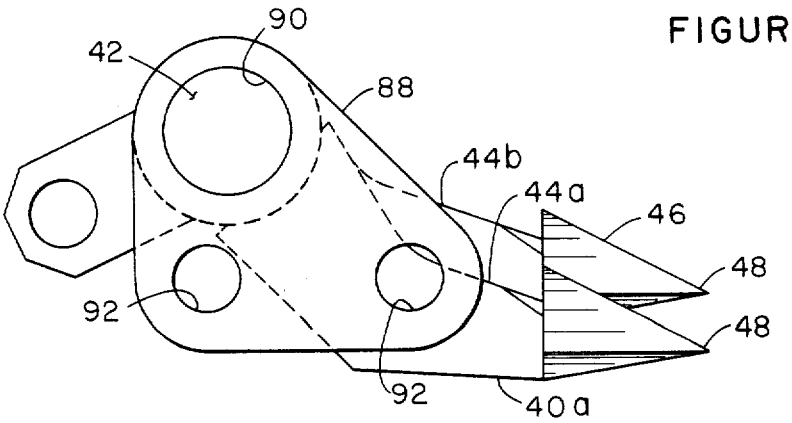
FIG. 12 is an end view of the breaker shaft shown in FIG. 7.

Movement of the breakers 40 along the desired line of travel adjacent the surface of the anode 10 is provided by a four-shaft linkage system. The linkage shafts are an upper shaft 72, a lower shaft 74, and shaft link pins 76, 76. The linkage system further comprises an upper pivot arm 78, a lower pivot arm 80 and a link 82. Upper pivot arm 78 is an angular plate member having a hole bored therethrough on its upper end of sufficient size to accommodate the upper shaft 72 and is attached near the end of the shaft preferably by welding. The lower pivot arm 80 is a substantially straight plate member having a hole bored therethrough on its upper end of sufficient size to accommodate the lower shaft 74, and is attached near the end of the shaft preferably by welding. The upper and lower pivot arms 78, 80 are welded to the respective shafts at substantially the same position with respect to the shaft ends in order that the arms lie in substantially the same plane. The link 82 is a substantially straight plate member having holes in either end to accommodate press fit bushings sized to receive the shaft link pins 76. To tie the free ends of the upper and lower pivot arms 78, 80 together, the free ends are bored and press fit with bushings and the shaft link pins 76 are then inserted through the bushings in both ends of the link 82 and the bushings in the arms 78, 80 to effect a freely rotatable link between the arms. The linked together upper and lower shafts 72, 74 are attached to the end plate 30 by means of a bearing mount 84. The bearing mount 84 is a rectangular plate fitted with bearings 86, 86 to accommodate the ends of shafts 72, 74 and is attached to the end plate 30. The foregoing linkage assembly of the upper and lower shafts 72, 74 and pivot arms 78, 80 and link 82 is tied to the breaker shaft 42 with breaker shaft end connector plates 88 (FIGS. 7 and 12). The end connector plate 88 is provided with a bored hole 90 to accommodate an end of the breaker shaft 42, and the plate is affixed thereto, preferably by welding. The plate 88 is generally triangular in shape, and bored holes 92 are provided in a lower portion of the plate and are sized and spaced apart a distance sufficient to engage with link pins 76, 76. After engaging the connector plate 88 with the pins 76, 76, the plate is attached to the pins, preferably by welding.

The foregoing description of the assembly of the upper and lower shafts 72, 74, the pivot arms 78, 80, the link 82, and the breaker shaft 42 has been made with respect to one end of one side of the apparatus. It is apparent that the same remarks are applicable to assembling the other ends of the respective left-hand right-hand side members.

Figure 6:
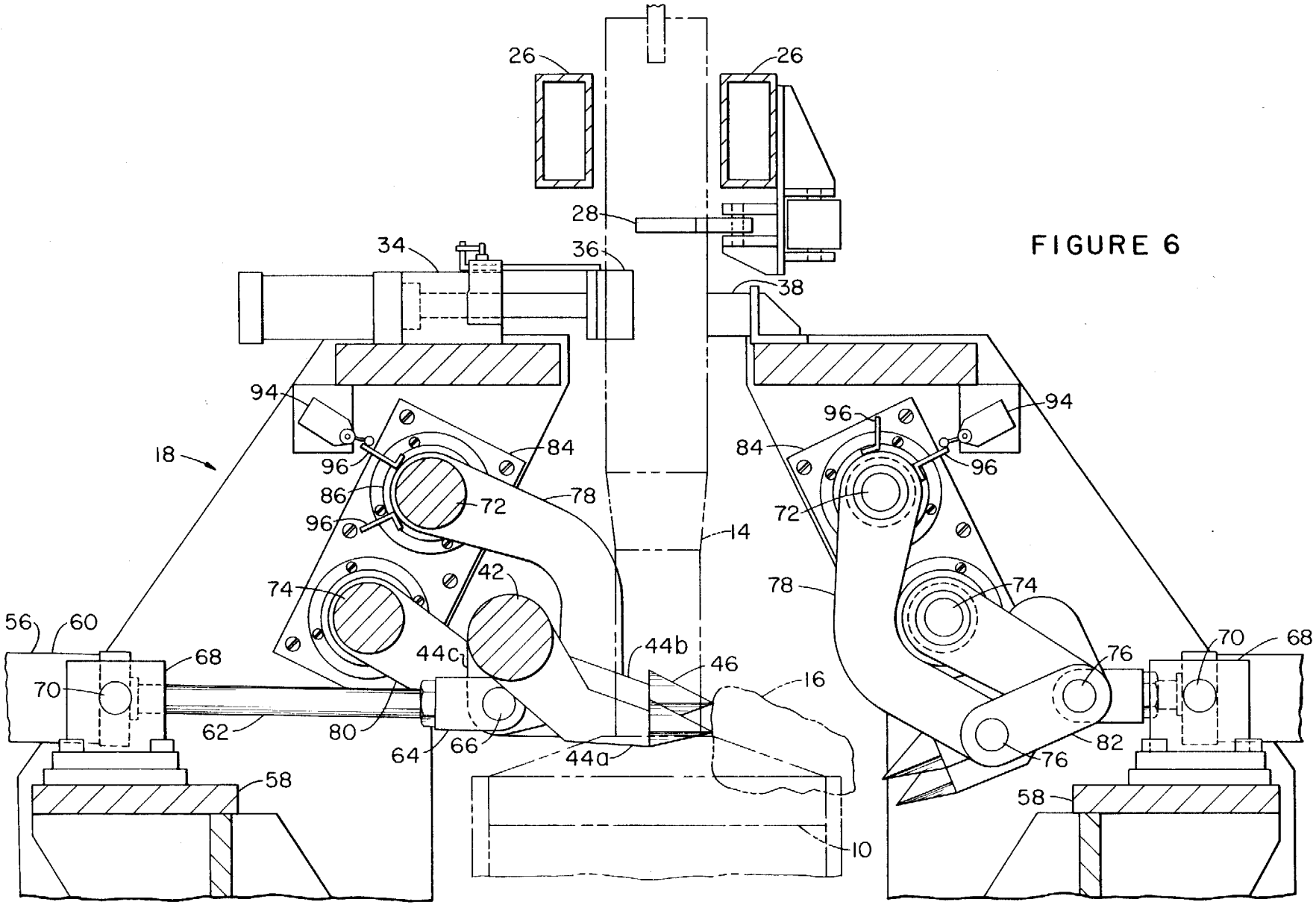
FIG. 6 is a sectional end view of the apparatus shown in FIG. 5 along section line 6—6 except that the apparatus on the right-hand side of FIG. 6 is shown in a fully retracted position rather than the closed position shown in FIG. 5.

Referring now to FIG. 6, apparatus of this invention is shown on the right-hand side with the crust breakers 40 in a fully retracted position. Anode butt 10 is disposed in the desired position within the apparatus and is maintained therein by clamp mouth 36 pressing anode rod 14 against the clamp back-up 38. The anode butt 10 is shown with a crust layer 16 on the right-hand side of the butt as it might appear prior to removal. To remove the crust 16, hydraulic power units 56 are actuated, whereby the piston shafts 62 act upon the breaker arms **44*c* and the previously described linkage to drive the breaker tips 46 along a line of travel adjacent the surface of the butt until the tips have progressed beyond the centerline of the butt, as shown on the left-hand side of FIG. 6. The action of the breaker tips 46 cause the crust to fracture into discrete pieces which separate from the butt and provide a substantially crust-free surface. It may be noted that breaker arm 44*a* has advanced on a line of travel below that traveled by breaker arm 44*b* to accommodate the beveled surface 11 of anode body 10**.

The movement of the crust breakers may be conveniently controlled by providing limit switches 94 adjacent the upper shaft 72. Limit switch actuators 96 are attached to the shaft at the appropriate positions to shut off the power to the hydraulic power units 56 after the breaker tips 46 have been advanced or retracted to the desired extent of travel.

Figure 13:
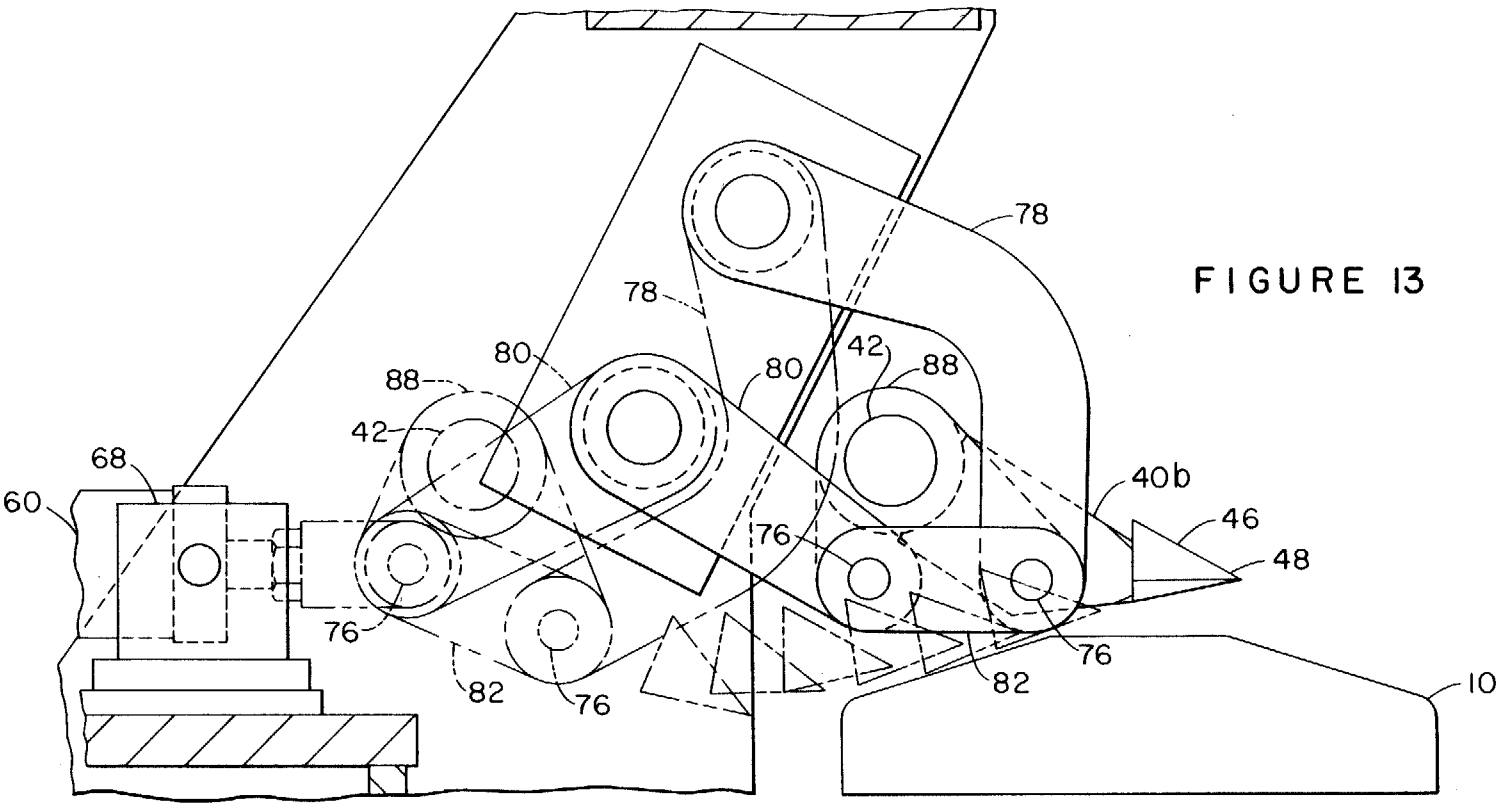
FIG. 13 is a schematic drawing showing the motion of the linkage and crust breaker of apparatus of this invention from a retracted to a closed position.

FIG. 13 further illustrates schematically how the movement of the crust breakers of apparatus of this invention is controlled. A butt 10 is shown in the desired position within the apparatus. Only the butt is shown for purposes of clarity, it being understood that the butt is held within the apparatus in a manner as previously described. By dashed lines, the upper pivot arm 78, lower pivot arm 80, link 82, breaker shaft end connector plate 88, and a breaker tip 46 on a breaker arm **40*b* are shown schematically in a fully retracted position. The same foregoing elements are shown as solid lines in the fully advanced position, and breaker tip 46** is shown in a series of positions along its line of travel from the retracted to advanced position in dotted lines.

After apparatus of this invention has been used in the manner described to fracture the crust on the butt surface, the apparatus is actuated to return the crust breakers to their retracted position. Although the crust is hard and not readily fractured, the bond between the crust and the butt is relatively light, and by fracturing the crust, substantially all of the crust breaks into discrete pieces which separate from the butt. Those loose pieces which remain on the butt after the breakers have been retracted can be brushed therefrom to fall into the hopper. There may be isolated sites on the butt having crust still adhering thereto, and such remaining crust may be removed by using a manually operated pneumatic hammer at this or a later station.

After substantially all of the crust has been removed from the butt, it is transported from the apparatus to another station for recovery of the carbon from the rod and another used butt assembly may be moved into the apparatus for crust removal.

While the invention has been described in terms of preferred embodiments, the claims appended hereto are intended to encompass all embodiments which fall within the spirit of the invention.

What is claimed is:

1. Apparatus for removing frozen electrolyte bath from an electrode body, the apparatus comprising:

a frame;

crust breaking means attached to said frame by linkage means adapted to move said crust breaking means along a predetermined line of travel, said crust breaking means adapted to penetrate and fracture electrolyte bath frozen on an electrode surface from application of a non-reciprocating unidirectional force to said crust breaking means; and power means to actuate the linkage means and apply sufficient non-reciprocating unidirectional force to said crust breaking means to penetrate and fracture crust frozen on an electrode body as said crust breaking means moves along the line of travel and thereby breaks such crust into discrete pieces which separate from the electrode body.

2. Apparatus as claimed in claim 1 wherein said frame includes a right- and left-hand side having a centerline and a space therebetween, the space sufficient to accommodate an electrode body having electrolyte bath frozen on surface portions thereof and said crust breaking means includes a left- and right-hand side crust breaking means on each of the left- and right-hand sides of said frame.

3. Apparatus as claimed in claim 1 or 2 which further includes clamp means to maintain an electrode body having frozen crust thereon in a fixed relationship with respect to the apparatus.

4. Apparatus as claimed in claim 1 or 2 which further includes power stop means to interrupt power to said crust breaking means after a predetermined distance of travel.

5. Apparatus as claimed in claim 1 or 2 wherein the linkage means is adapted to move said crust breaking means along a predetermined line of travel substantially adjacent to surface portions of an electrode body held in a predetermined fixed relationship with respect to the apparatus.

6. Apparatus as claimed in claim 1 or 2 wherein said crust breaking means includes a tapering end portion to facilitate penetration of the crust.

7. Apparatus as claimed in claim 1 or 2 wherein said crust breaking means is a plurality of crust breaker elements spaced apart longitudinally along a shaft.

8. Apparatus as claimed in claim 7 wherein the elements have a tapered crust breaking end to facilitate penetration of the crust.

9. Apparatus as claimed in claim 7 wherein the elements are sufficient in number and spaced apart a distance suitable to fracture substantially all of the crust in an area encompassed by the longitudinal extent of the shaft and the distance traveled by the elements along the line of travel.

10. Apparatus as claimed in claim 7 wherein the linkage is adapted to advance the elements along a line of travel substantially adjacent to surfaces of an electrode body having electrolyte bath frozen thereon with the body fixed in a predetermined relationship with respect to the apparatus.

* * * * *